US006811041B1

(12) United States Patent
Juliano

(10) Patent No.: US 6,811,041 B1
(45) Date of Patent: Nov. 2, 2004

(54) FILE SUSPENSION DEVICE

(76) Inventor: Vincent Juliano, 242-18 54th Ave., Douglaston, NY (US) 11362-1507

( * ) Notice: Subject to any disclaimer, the term of this patent is extended or adjusted under 35 U.S.C. 154(b) by 0 days.

(21) Appl. No.: 10/286,738

(22) Filed: Nov. 1, 2002

Related U.S. Application Data

(62) Division of application No. 09/666,923, filed on Sep. 21, 2000, now abandoned.

(51) Int. Cl.[7] ..... A47F 7/16

(52) U.S. Cl. ..... 211/46; 211/181.1; 211/124

(58) Field of Search ..... 211/183, 181.1, 211/46, 124; 312/183, 184; 248/226.11, 228.5, 228.6, 228.7, 230.7, 231.81, 316.7, 101, 95

(56) References Cited

U.S. PATENT DOCUMENTS

| | | | | | |
|---|---|---|---|---|---|
| 2,238,877 | A | * | 4/1941 | Anderson | 248/223.41 |
| 2,257,052 | A | * | 9/1941 | Hanna | 211/46 |
| 2,839,201 | A | * | 6/1958 | Auster | 211/86.01 |
| 3,228,640 | A | * | 1/1966 | Wolsh | 248/72 |
| 3,281,193 | A | | 10/1966 | Murray | |
| 3,363,341 | A | * | 1/1968 | Glassman | 434/417 |
| 3,456,994 | A | | 7/1969 | Sullivan | |
| 3,682,522 | A | | 8/1972 | Splan | |
| 3,896,962 | A | | 7/1975 | Smith | |
| 3,938,870 | A | | 2/1976 | Guest et al. | |
| 4,030,610 | A | | 6/1977 | Alexander | |
| 4,234,238 | A | * | 11/1980 | Figueroa | 312/184 |
| D275,945 | S | | 10/1984 | Adell | |
| 4,526,277 | A | | 7/1985 | Snowden et al. | |
| 4,765,490 | A | | 8/1988 | Hanson | |
| 4,901,867 | A | | 2/1990 | Petty, Jr. | |
| 4,913,302 | A | | 4/1990 | Stonier | |
| 5,048,697 | A | | 9/1991 | Payne | |
| RE33,953 | E | | 6/1992 | Everts | |
| 5,193,701 | A | | 3/1993 | Bush et al. | |
| 5,199,809 | A | * | 4/1993 | Semerjian | 402/4 |
| 5,205,626 | A | * | 4/1993 | Fotioo | 312/184 |
| 5,255,798 | A | | 10/1993 | Aaldenberg et al. | |
| 5,314,151 | A | * | 5/1994 | Carter-Mann | 248/100 |
| 5,328,259 | A | | 7/1994 | Meriaux | |
| 5,396,996 | A | * | 3/1995 | Box | 211/46 |
| 5,842,570 | A | | 12/1998 | Turnbull | |
| 5,967,337 | A | * | 10/1999 | Fitzburgh | 211/40 |
| 5,989,676 | A | * | 11/1999 | Davis et al. | 428/83 |
| 6,550,874 | B2 | * | 4/2003 | Walla et al. | 312/184 |
| 6,601,809 | B1 | * | 8/2003 | Gebrara | 248/229.16 |

* cited by examiner

*Primary Examiner*—Carl D. Friedman
*Assistant Examiner*—Jennifer E. Novosad

(57) ABSTRACT

A file suspension device for holding hanging file folders in a box. The file suspension device includes a frame. The frame has an elongate first rod, an elongate second rod, an elongate third rod and an elongate fourth rod. A fastening structure is provided on at least two of the rods for removably fastening each of the at least two rods on the top edge of one of the walls of the box. The fastening structure pinches an upper portion of the wall when the fastening structure is fastened to the wall for retaining an associated rod on the wall.

16 Claims, 2 Drawing Sheets

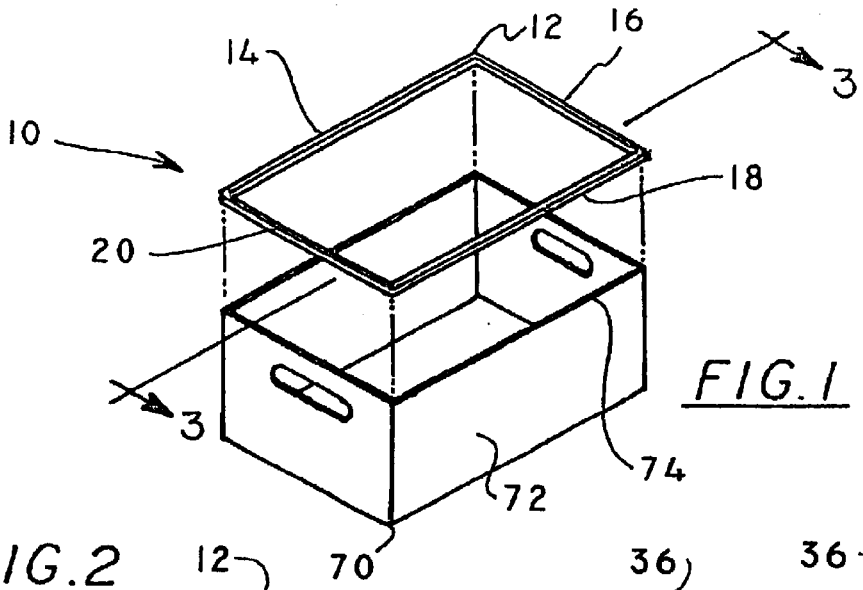
FIG. 1
FIG. 2
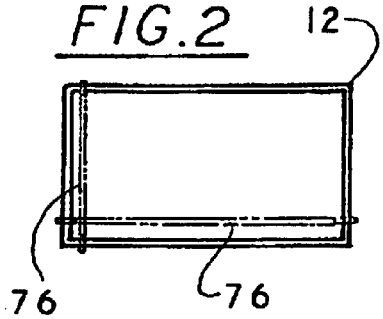
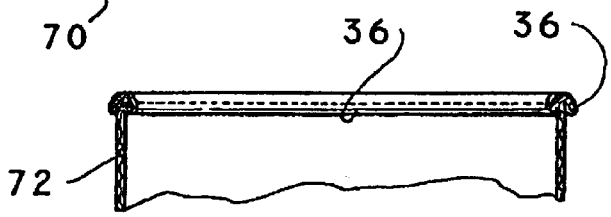
FIG. 3a
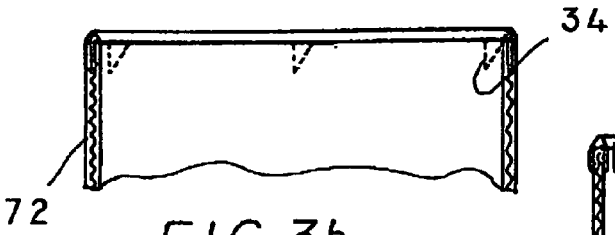
FIG. 3b
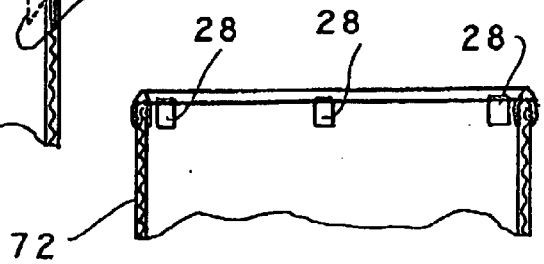
FIG. 3c

FILE SUSPENSION DEVICE

CROSS REFERENCE TO RELATED APPLICATION

This application is a divisional of Application No. 09/666,923, filed Sep. 21, 2000 now abandoned.

BACKGROUND OF THE INVENTION

1. Field of the Invention

The present invention relates to file suspension devices and more particularly pertains to a new file suspension device for holding hanging file folders in a box.

2. Description of the Prior Art

The use of file suspension devices is known in the prior art. More specifically, file suspension devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,193,701; 3,682,522; 5,842,570; 3,896,962; 3,456,994; and U.S. Des. Pat. No. 275,945.

While these devices fulfill their respective, particular objectives and requirements, the aforementioned patents do not disclose a new file suspension device. The inventive device includes a frame. The frame has a frame having an elongate first rod, an elongate second rod, an elongate third rod and an elongate fourth rod. A fastening structure is provided on at least two of the rods for removably fastening each of the at least two rods on the top edge of one of the walls of the box. The fastening structure pinches an upper portion of the wall when the fastening structure is fastened to the wall for retaining an associated rod on the wall.

In these respects, the file suspension device according to the present invention substantially departs from the conventional concepts and designs of the prior art, and in so doing provides an apparatus primarily developed for the purpose of holding hanging file folders in a box.

SUMMARY OF THE INVENTION

In view of the foregoing disadvantages inherent in the known types of file suspension devices now present in the prior art, the present invention provides a new file suspension device construction wherein the same can be utilized for holding hanging file folders in a box.

The general purpose of the present invention, which will be described subsequently in greater detail, is to provide a new file suspension device apparatus and method which has many of the advantages of the file suspension devices mentioned heretofore and many novel features that result in a new file suspension device which is not anticipated, rendered obvious, suggested, or even implied by any of the prior art file suspension devices, either alone or in any combination thereof.

To attain this, the present invention generally comprises a frame. The frame has an elongate first rod, an elongate second rod, an elongate third rod and an elongate fourth rod. A fastening structure is provided on at least two of the rods for removably fastening each of the at least two rods on the top edge of one of the walls of the box. The fastening structure pinches an upper portion of the wall when the fastening structure is fastened to the wall for retaining an associated rod on the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new file suspension device apparatus and method which has many of the advantages of the file suspension devices mentioned heretofore and many novel features that result in a new file suspension device which is not anticipated, rendered obvious, suggested, or even implied by any of the prior art file suspension devices, either alone or in any combination thereof.

It is another object of the present invention to provide a new file suspension device which may be easily and efficiently manufactured and marketed.

It is a further object of the present invention to provide a new file suspension device which is of a durable and reliable construction.

An even further object of the present invention is to provide a new file suspension device which is susceptible of a low cost of manufacture with regard to both materials and labor, and which accordingly is then susceptible of low prices of sale to the consuming public, thereby making such file suspension device economically available to the buying public.

Still yet another object of the present invention is to provide a new file suspension device which provides in the apparatuses and methods of the prior art some of the advantages thereof, while simultaneously overcoming some of the disadvantages normally associated therewith.

Still another object of the present invention is to provide a new file suspension device for holding hanging file folders in a box.

Yet another object of the present invention is to provide a new file suspension device which includes a frame. The frame has a frame having an elongate first rod, an elongate second rod, an elongate third rod and an elongate fourth rod. A fastening structure is provided on at least two of the rods for removably fastening each of the at least two rods on the top edge of one of the walls of the box. The fastening structure pinches an upper portion of the wall when the fastening structure is fastened to the wall for retaining an associated rod on the wall.

Still yet another object of the present invention is to provide a new file suspension device that allows a conventional storage box to be used for supporting hanging file folders in a vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new file suspension device according to the present invention.

FIG. 2 is a schematic top view of the present invention.

FIG. 3*a* is a schematic cross-sectional view of elongate clip members taken along line 3—3 of the present invention.

FIG. 3*b* is a schematic cross-sectional view of blade members taken along line 3—3 of the present invention.

FIG. 3*c* is a schematic cross-sectional view of clip members taken along line 3—3 of the present invention.

DESCRIPTION OF THE PREFERRED EMBODIMENT

Figure 4:
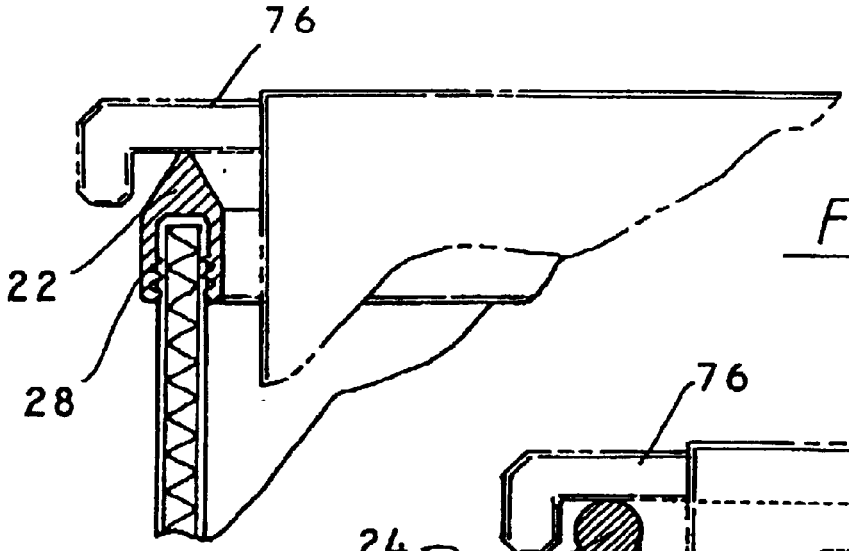
FIG. 4 is a schematic exploded view of the triangular shaped rod of the present invention.

With reference now to the drawings, and in particular to FIGS. 1 through 6 thereof, a new file suspension device embodying the principles and concepts of the present invention and generally designated by the reference numeral 10 will be described.

Figure 5:
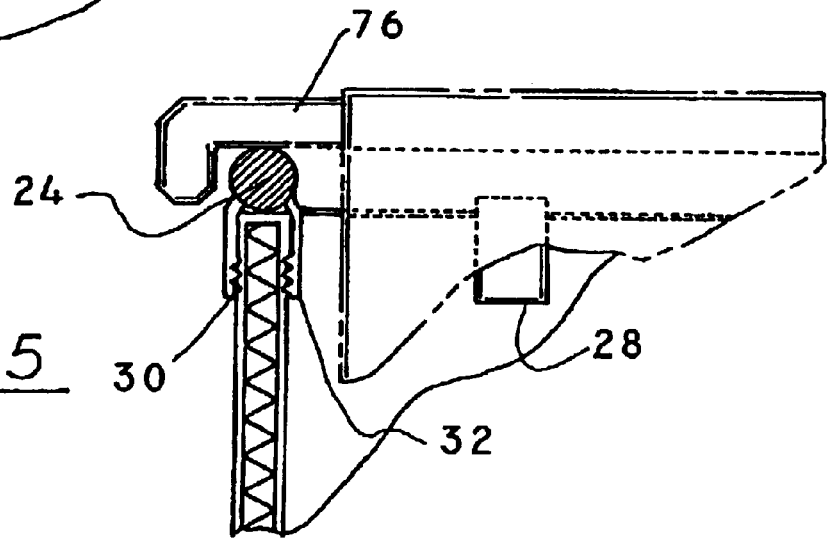
FIG. 5 is a schematic exploded view of the circular shaped rod of the present invention.
Figure 6:
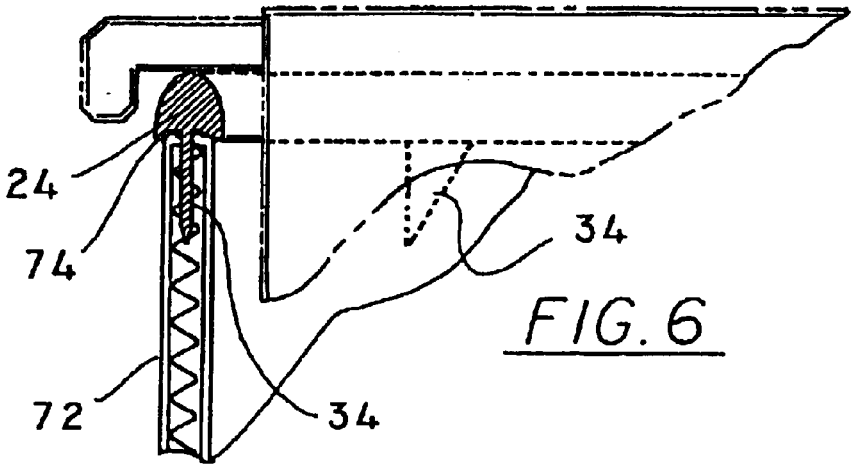
FIG. 6 is a schematic exploded view of the domed shaped rod of the present invention.

As best illustrated in FIGS. 1 through 6, the file suspension device 10 generally comprises a device 10 for removably fastening to a conventional cardboard or plastic storage box 70. The box 70 has four vertical walls 72 each having a top edge 74. The device 10 includes a frame 12. The frame 12 has a first rod 14, a second rod 16, a third rod 18 and a fourth rod 20. Each of the rods is elongate. Each of the rods is coupled together such that the frame 12 generally has a rectangular shape. FIG. 4 shows the first embodiment 22 wherein a cross section of each of the rods generally has a triangular shape taken perpendicular to a longitudinal axis of the rods such that an upper surface of the rods is pointed. FIG. 5 shows the second embodiment 24 having a circular cross-section and FIG. 6 shows the third embodiment 26 having a domed cross-section. All of the Figures demonstrate a small surface area being in contact with the hanging file folder 76. This allows the file folders to slide easily across the rods.

A plurality of fastening means removably fasten each of the rods to one of the top edges. Each of the fastening means is coupled to and extends downwardly from one of the rods such that each of the rods has a plurality of fastening means coupled thereto. FIG. 4 and 5 show fastening means comprising clip members 28 integrally coupled to and extending downwardly from a bottom surface of the rods. Each of the clip members 28 has a first portion 30 and a second portion 32 extending downwardly from the rod. The first 30 and second 32 portions each preferably comprise a resiliently flexible material such that the first 30 and second 32 portions are biased towards each other. FIG. 6 depicts fastening means comprising blade members 34 each having a pointed edge extending downwardly from the rods. Each of the blade members 34 is ideally positioned in a plane orientated generally parallel to the respective longitudinal axis of the rod the blade member is securely coupled to. The blade members 34 are inserted into the top edges 74 of the walls 72 as shown in FIG. 6. FIG. 3*a* depicts clip members 36 which are elongate and are each coupled along a length of the rod.

In greater detail, the first and second portions of the clip member form a gap therebetween for receiving the top portion of the wall of the box. The resiliently flexible material of the first and second portions are resiliently biased towards each other when the first second portions are pushed away from each other by insertion of one of the walls into the gap. Preferably, the gap between the first and second portions is slightly smaller than the thickness of the wall on which the clip member is to be mounted so that the portions are flexed somewhat out of their normal, unmounted positions. The first and second portions may extend in a substantially parallel relationship from a bottom surface of each of the rods. In one embodiment of the invention, at least one gripping rib is mounted on each of the first and second portions and extends into the gap for resisting sliding movement of the top portion of the wall of the box from sliding with respect to the first and second portions. The clip member may extend substantially the entire length of the associated rod, as shown in FIG. 4, or a plurality of the clip members may be positioned at spaced locations on the associated rod as shown in FIG. 5.

In use, the device is positioned over the top peripheral edge of a box. The device strengthens the integrity of the box and allows hanging file folders to be placed in the box such that the file folders slide easily along the top edge of the box.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A file suspension device for removably fastening to a box to suspend files therefrom, the box being of the type having four vertical walls, each of the walls having a top edge, the device comprising:

a frame having an elongate first rod, an elongate second rod, an elongate third rod and an elongate fourth rod; and fastening means on at least two of the rods for removably fastening each of the at least two rods on the top edge of one of the walls of the box, the fastening means being adapted to pinch an upper portion of the wall when the fastening means is fastened to the wall for retaining an associated rod on the wall;

wherein each of the rods has a transverse cross section taken perpendicular to a longitudinal axis of the rods that is generally circular in shape.

2. The file suspension device as in claim 1, wherein each of the fastening means comprises a clip member being coupled to one of the rods, the clip member comprising a first portion and a second portion forming a gap therebetween for receiving the top portion of the wall of the box.

3. The file suspension device of claim 2 wherein each of the first and second portions are formed from a resiliently flexible material such that the first and second portions are resiliently biased towards each other when the portions are pushed away from each other by insertion of one of the walls into the gap.

4. The file suspension device of claim 2 wherein the first and second portions extend downwardly in a substantially parallel relationship from a bottom surface of each of the rods.

5. The file suspension device of claim 2 wherein each of the first and second portions has at least one gripping rib mounted thereon and extending into the gap for resisting sliding movement of the top portion of the wall of the box from sliding with respect to the first and second portions.

6. The file suspension device of claim 1 wherein the fastening means comprises a clip member extending for substantially an entire length of the associated rod.

7. The file suspension device of claim 1 wherein the fastening means comprises a plurality of clip members positioned at spaced locations on the associated rod.

8. A file suspension device for removably fastening to a box to suspend files therefrom, the box being of the type having four vertical walls, each of the walls having a top edge, the device comprising:

a frame having an elongate first rod, an elongate second rod, an elongate third rod and an elongate fourth rod; and fastening means on at least two of the rods for removably fastening each of the at least two rods on the ton edge of one of the walls of the box, the fastening means being adapted to pinch an upper portion of the wall when the fastening means is fastened to the wall for retaining an associated rod on the wall;

wherein each of the rods has a transverse cross section taken perpendicular to a longitudinal axis of the rods that is generally triangular in shape.

9. The file suspension device as in claim 8, wherein each of the fastening means comprises a clip member being coupled to one of the rods, the clip member comprising a first portion and a second portion forming a gap therebetween for receiving the top portion of the wall of the box.

10. The file suspension device of claim 9 wherein each of the first and second portions are formed from a resiliently flexible material such that the first and second portions are resiliently biased towards each other when the portions are pushed away from each other by insertion of one of the walls into the gap.

11. The file suspension device of claim 9 wherein the first and second portions extend downwardly in a substantially parallel relationship from a bottom surface of each of the rods.

12. The file suspension device of claim 9 wherein each of the first and second portions has at least one gripping rib mounted thereon and extending into the gap for resisting sliding movement of the top portion of the wall of the box from sliding with respect to the first and second portions.

13. The file suspension device of claim 8 wherein the fastening means comprises a clip member extending for substantially an entire length of the associated rod.

14. The file suspension device of claim 8 wherein the fastening means comprises a plurality of clip members positioned at spaced locations on the associated rod.

15. A file suspension device for removably fastening to a box to suspend files therefrom, the box being of the type having four vertical walls, each of the walls having a top edge, the device comprising:

a frame having an elongate first rod, an elongate second rod, an elongate third rod and an elongate fourth rods; and fastening means on at least two of the rods for removably fastening each of the at least two rods on the top edge of one of the walls of the box, the fastening means being adapted to pinch an upper portion of the wall when the fastening means is fastened to the wall for retaining an associated rod on the wall;

wherein each of the rods has a transverse cross section taken perpendicular to a longitudinal axis of the rods with an upper surface having a domed shape.

16. A file suspension device for removably fastening to a box to suspend files therefrom, the box being of the type having four vertical walls, each of the walls having a top edge, the device comprising:

a frame having an elongate first rod, an elongate second rod, an elongate third rod and an elongate fourth rod, each of the rods being coupled together such that the frame generally has a rectangular shape; and fastening means on at least two of the rods for removably fastening each of the at least two rods on the top edge of one of the walls of the box, the fastening means being adapted to pinch an upper portion of the wall when the fastening means is fastened to the wall for retaining an associated rod on the wall;

wherein each of the fastening means comprises a clip member being coupled to one of the rods, the clip member comprising a first portion and a second portion forming a gap therebetween for receiving the top portion of the wall of the box;

wherein each of the first and second portions are formed from a resiliently flexible material such that the first and second portions are resiliently biased towards each other when the portions are pushed away from each other by insertion of one of the walls into the gap;

wherein the first and second portions extend downwardly in a substantially parallel relationship from a bottom surface of each of the rods;

wherein each of the first and second portions has at least one gripping rib mounted thereon and extending into the gap for resisting sliding movement of the top portion of the wall of the box from sliding with respect to the first and second portions;

wherein the clip member extends for substantially an entire length of the associated rod; and wherein each of the rods has a transverse cross section taken perpendicular to a longitudinal axis of the rods that is generally triangular in shape.

* * * * *